US005431005A

United States Patent [19]

Fehrer

[11] Patent Number: 5,431,005

[45] Date of Patent: Jul. 11, 1995

[54] DRAWING FRAME FOR A RING SPINNING APPARATUS

[76] Inventor: Ernst Fehrer, Auf der Gugl 28, A-4020 Linz, Austria

[21] Appl. No.: 192,870

[22] Filed: Feb. 7, 1994

[30] Foreign Application Priority Data

Feb. 15, 1993 [AT] Austria ..... 272/93

[51] Int. Cl.[6] ..... D01H 1/42; D01H 13/04

[52] U.S. Cl. ..... 57/315; 19/288; 57/352

[58] Field of Search ..... 57/315, 317, 318, 328, 57/75, 90, 352; 19/236, 106 R, 288, 286

[56] References Cited

U.S. PATENT DOCUMENTS

| | | | |
|---|---|---|---|
| 4,475,272 | 10/1984 | Wood | 19/288 |
| 4,953,349 | 9/1990 | Fehrer | 57/315 |
| 5,085,046 | 2/1992 | Fehrer | 57/315 |
| 5,090,192 | 2/1992 | Stahlecker | 57/315 |
| 5,285,624 | 2/1994 | Stahlecker | 57/328 |

FOREIGN PATENT DOCUMENTS

| | | | |
|---|---|---|---|
| 391328 | 9/1990 | Austria . | |
| 395865 | 3/1993 | Austria . | |
| 2215743 | 9/1989 | United Kingdom | 57/315 |

*Primary Examiner*—Joseph J. Hail, III

*Attorney, Agent, or Firm*—Collard & Roe

[57] ABSTRACT

For use with a ring spinning apparatus, a drawing frame is described, which comprises two delivery rollers, which define between them an exit nip for a drawn fibrous roving and one of which defines on its air-permeable peripheral surface a deflecting path for the fibrous roving being delivered and a suction zone, which extends along the deflecting path between the exit nip and a pressure, applying roller, which is peripherally spaced from said nip, and the suction zone comprises two juxtaposed and laterally spaced apart branch suction zones, and a blast nozzle is disposed between said branch suction zones and is operable to direct an air blast against the suction-free area which is disposed between the branch zones, whereby the drawn fibrous roving is divided into two branch rovings. The two branch suction zones merge in the suction zone upstream of the pressure-applying roller into a peripherally extending common suction zone portion.

1 Claim, 2 Drawing Sheets

DRAWING FRAME FOR A RING SPINNING APPARATUS

BACKGROUND OF THE INVENTION

1. Field of the Invention

This invention relates to a drawing frame for a ring spinning apparatus, which drawing frame comprises two delivery rollers, which define between them an exit nip for a drawn fibrous roving and one of which defines on its air-permeable peripheral surface a deflecting path for the fibrous roving being delivered and a suction zone, which extends along the deflecting path between the exit nip and a pressure-applying roller, which is peripherally spaced from said nip, and said suction zone comprises two juxtaposed and laterally spaced apart branch suction zones, and a blast nozzle is disposed between said branch suction zones and is operable to direct an air blast against the suction-free area which is disposed between said branch suction zones, whereby the drawn fibrous roving is divided into two branch rovings.

2. Description of the Prior Art

It is desired to supply the ring spinning apparatus with a narrow drawn sliver which substantially conforms to the cross-section of the yarn which is to be made. For that purpose it is known from Austrian Patent Specification 391,328 to provide a suction zone on the air-permable peripheral surface of one of the two delivery rollers of the drawing frame downstream of the exit nip and to provide at least on one side of said suction zone a blast nozzle for directing an air blast transversely to the suction zone. When the drawn fibrous roving is held against a lateral displacement in the exit nip defined by the delivery rollers of the drawing frame and in a guiding gap which is defined by a succeeding pressure-applying roller the suction stream and the air blast cooperate to bundle the roving and to form a comparatively narrow sliver. The narrow sliver which leaves the guiding gap that is defined by the pressure-applying roller facilitates the twisting of the fibers by the revolving traveler of the ring spinning apparatus because there is no longer a need to converge laterally spaced apart fibers of a wider sliver in a distinctly triangular zone to form a roving which is circular in cross-section. The twisting conditions will be the more favorable the smaller is the size of that spinning triangle, particularly because the roving has only a very low strength at the spinning triangle in which the roving has not yet been twisted.

To eliminate the need for an expensive making of bundled rovings for ring spinning operations it is also known from Austrian Patent Specification 395 865 to divide a drawn roving into two branch rovings in an arrangement in which the suction zone on the periphery of one delivery roller of the drawing frame is divided into two laterally spaced apart branch suction zones and a blast nozzle is directed toward a suction-free area existing on the periphery of the delivery roller between said branch suction zones. As a result, the suction streams and the air blast cooperate to urge the fibers of the drawn roving apart and thus to form two branch rovings ant each branch roving will be bundled at the same time because the air blast has a distinct component of flow which is transverse to the branch rovings. This will result in a desirable decrease of the size of the spinning triangle which succeeds the guide gap defined between one delivery rollers and the pressure-applying roller adjacent to each branch roving.

SUMMARY OF THE INVENTION

It is an object of the invention to decrease by the use of simple means the size of the spinning triangle which is formed by a single roving downstream of the guiding gap which is defined between a delivery roller of the drawing frame and a pressure-applying roller.

In a drawing frame which is of the kind described first hereinbefore that object is accomplished in accordance with the invention in that the two branch suction zones merge in the suction zone upstream of the pressure-applying roller into a peripherally extending common suction zone portion.

Because owing to the smaller number of fibers in the cross-section of branch rovings the latter can more easily be bundled, a particularly effective bundling will be effected if a complete roving which is to be bundled is divided into branch rovings, which are individually bundled, and the bundled branch rovings are subsequently combined in a bundled complete roving, which can be transformed in an only very shall spinning triangle to the cross-sectional shape that is desired for the yarn. That transformation will not be influenced by the fact that the fibers were previously divided into the two branch rovings because the division was only temporary and will not affect the yarn.

DETAILED DESCRIPTION OF THE PREFERRED EMBODIMENT

An illustrative embodiment will now be explained more in detail with reference to the schematic drawing.

Figure 1:
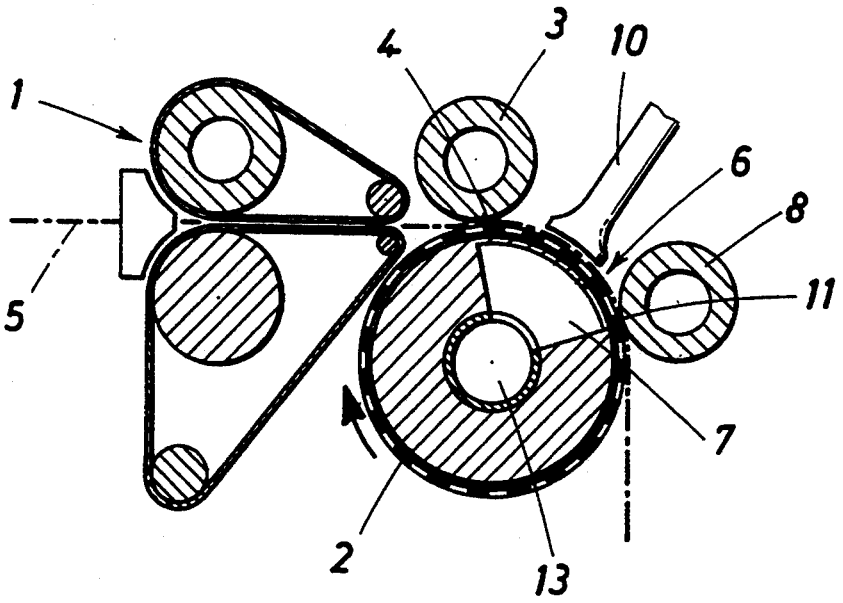
FIG. 1 is a simplified axial sectional view showing a part of a drawing frame which is provided in accordance with the invention for use with a ring spinning apparatus.
Figure 2:
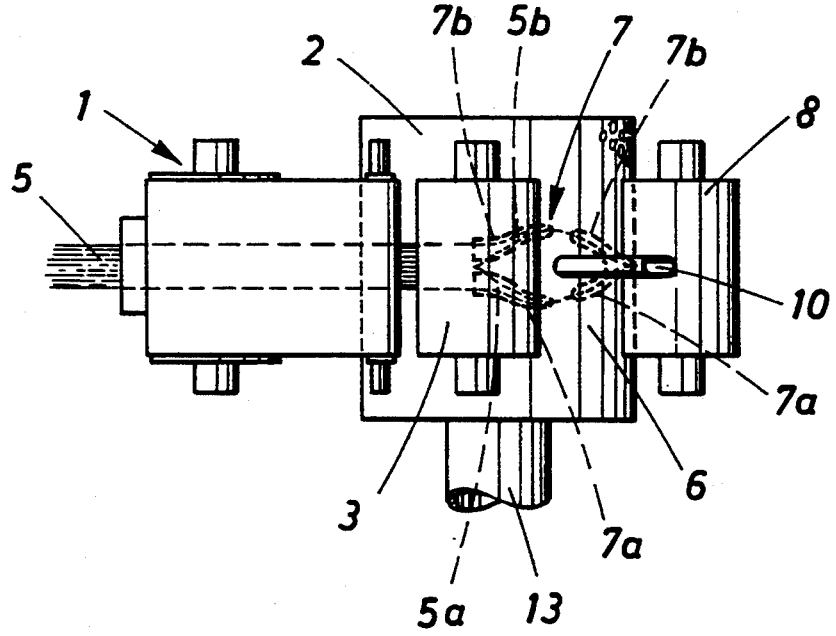
FIG. 2 is a top plan view showing that portion of the drawing frame which comprises the delivery roller which is provided with the suction zone.
Figure 3:
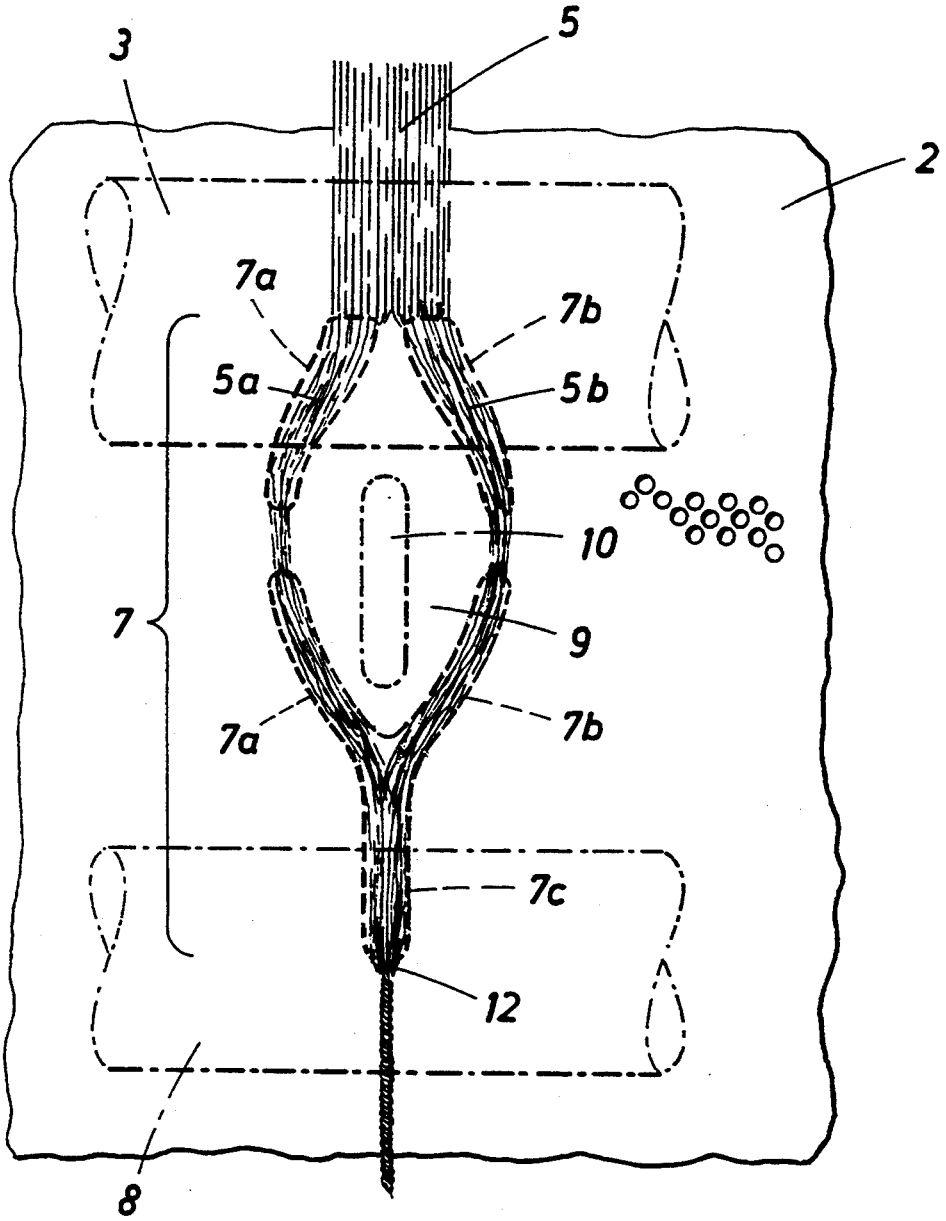
FIG. 3 is a top plan view showing a developed suction zone of the one delivery roller.

The drawing frame 1 shown in the drawing is intended for use with a conventional ring spinning apparatus, which is not shown. The drawing frame 1 comprises two delivery rollers 2 and 3, which define between them an exit nip 4 for delivering a drawn roving 5. The delivery roller 2 is disposed under the other delivery roller 3 and defines for the roving 5 a deflecting path 6, which includes on the air-permable peripheral surface of the roller 2 a suction zone 7, which comprises two juxtaposed branch suction zones **7*a* and 7*b*, which are laterally spaced apart. Said branch suction zones 7*a* and 7*b* extend from the exit nip 4 and initially diverge to a maximum lateral spacing and thereafter continuously converge and closely upstream of a pressure-applying roller 8 merge in a common suction zone 7*c*, which extends in the peripheral direction of the delivery roller 2. A blast nozzle 10 is directed against the suction-free area 9 between the branch suction zones 7*a* and 7*b*. The suction streams produced by the branch suction zones 7*a* and 7*b* and the air blast produced by the blast nozzle 10 have the result that the drawn fibrous roving 5 which leaves the exit nip 4 is divided into two branch rovings 5*a* and 5*b*, which extend along the two branch suction zones 7*a* and 7*b*, and the fibers of each of said branch rovings are bundled at the same time. Because the bundled branch rovings 5a and 5b merge before the pressure-applying roller 8 in a bundled complete roving 5** in the suction zone *7c*, a properly bundled fibrous roving 5 will pass through the guiding gap 11 which is defined between the delivery roller 2 and the pressure-applying roller 8 and said complete roving can be twisted after passing through a spinning triangle 12 which is very small, as is apparent from FIG. 3, and will not disturb the twisting.

The configurations of the branches *7a* and *7b* of the suction zone 7 will be determined by the design of a suction insert 13 provided in the delivery roller 2 and may be adapted to the requirements of a given application in that the suction insert 13 is replaced. For the purposes of the invention it is decisive that the fibers are bundled in the branch rovings 5a and 5b, which are subsequently recombined in a complete roving 5 which has been bundled more effectively than a complete roving which would have been bundled in an undivided state.

It is apparent that the drawing frame 1 for delivering a bundled fibrous roving 5 to a ring spinning apparatus comprises two delivery rollers 2 and 3, which define between thrum an exit nip 4 for delivering a drawn fibrous roving 4, and a pressure-applying roller 8, which defines with the delivery roller 2 a guiding gap 11, which is peripherally spaced apart from the exit nip 4 and defines with the exit nip 4 a deflecting path 6 for the roving 9 on the air-permeable peripheral surface of the delivery roller 2. The delivery roller 2 contains a stationary suction insert 13, which defines on the peripheral surface of the delivery roller 2 at said deflecting path 6 a stationary suction zone 7, which comprises two juxtaposed branch suction zones *7a* and *7b*, which are laterally spaced apart to define between them a suction-free area 9 on the peripheral surface of the delivery roller 2.

A blast nozzle 10 is provided for directing an air blast against the suction-free area 9. The suction insert 13 and the blest nozzle 10 are operable to divide the drawn roving 5 on the peripheral surface of the delivery roller 2 into two branch rovings 5a and 5b extending on the peripheral surface of the delivery roller 2 along the branch suction zones *7a* and *7b* and to bundle the fibers in each of said branch rovings.

The suction insert 13 defines on the air-permeable peripheral surface of the delivery roller 2 a peripherally extending common suction zone portion *7c* between the branch suction zones *7a* and *7b* and the guiding gap 11. The branch suction zones *7a* and *7b* merge into said common suction zone portion *7c*.

I claim:

1. In a drawing frame for delivering a bundled fibrous roving to a ring spinning apparatus, which drawing frame comprises two delivery rollers, which define between them an exit nip for delivering a drawn fibrous roving and one of which has an air-permeable peripheral surface, a pressure-applying roller downstream of the exit nip defining with said one delivery roller a guiding gap, which is peripherally spaced apart from said exit nip and defines with said exit nip a deflecting path for said drawn roving on said peripheral surface of said one delivery roller, stationary suction means defining on said peripheral surface of said one delivery roller at said deflecting path a stationary suction zone comprising two juxtaposed branch suction zones, which are laterally spaced apart to define between them a suction-free area on said peripheral surface of said one delivery roller, and a blast nozzle for directing an air blast against said suction-free area, whereby said suction means and said blast nozzle are operable to divide said drawn roving into two branch rovings extending along said two branch suction zones on said peripheral surface of said one delivery roller and to bundle each of said branch rovings, the improvement residing in that said suction means define on said peripheral surface of said one delivery roller a peripherally extending common suction zone portion between said two branch suction zones and said guiding gap, and said two branch suction zones merge into said common suction zone portion.

* * * * *